US005892426A

United States Patent [19]

Huang

[11] Patent Number: 5,892,426

[45] Date of Patent: Apr. 6, 1999

[54] SAFETY SWITCH WITH SECURITY STRUCTURE

[76] Inventor: Tse-Chuan Huang, 8F, No. 27, Lane 3, Tsao-Ti-Wei, Shen-Keng Hsiang, Taipei County, Taiwan

[21] Appl. No.: 96,528

[22] Filed: Jun. 12, 1998

[51] Int. Cl.[6] ..... H01H 71/16; H01H 75/58; H01H 71/54; H01H 71/14

[52] U.S. Cl. ..... 337/59; 337/66; 337/345; 337/334; 337/68

[58] Field of Search ..... 337/59, 66, 334, 337/345, 76, 53, 67, 68, 69, 74, 75, 140, 79, 91

[56] References Cited

U.S. PATENT DOCUMENTS

| | | | |
|---|---|---|---|
| 4,833,439 | 5/1989 | Bowden et al. | 337/68 |
| 4,922,219 | 5/1990 | Bakhaus et al. | 337/74 |
| 4,937,548 | 6/1990 | Sdunek | 337/70 |
| 5,262,748 | 11/1993 | Tsung-Mou | 337/66 |
| 5,453,725 | 9/1995 | You et al. | 337/68 |
| 5,539,371 | 7/1996 | Yu | 337/66 |
| 5,541,569 | 7/1996 | Jang | 337/68 |

*Primary Examiner*—Leo P. Picard
*Assistant Examiner*—Anatoly Vortman
*Attorney, Agent, or Firm*—Bacon & Thomas

[57] ABSTRACT

A titterboard type switch with security structure, wherein a relay unit is disposed between two terminal legs connected with power wires and an electrothermal conductor is connected between the relay unit and one of the terminal legs, whereby when powered on, the electrothermal conductor is slightly heated and in the case of overload, the electrothermal conductor creates high temperature. The relay unit is disposed with a resilient movable contact pushable by a sliding member for controlling whether the movable contact contacts with the other terminal leg or not. The sliding plate is pushed by a swinging plate which is shifted by a push button via a linking unit. A bimetallic plate is disposed between the electrothermal conductor and the swinging plate, whereby when the electrothermal conductor creates high temperature due to overload, the bimetallic plate is deformed to release the movable contact from pressing force of the swinging plate, whereby the movable contact is resiliently restored to a power cut state to ensure safety from overload.

12 Claims, 3 Drawing Sheets

SAFETY SWITCH WITH SECURITY STRUCTURE

BACKGROUND OF THE INVENTION

The present invention relates to a titterboard type switch with overload protection function, and more particularly to a switch with security structure, wherein a bimetallic plate is disposed between an electrothermal conductor and a swinging member. In case of passing of excessively great current, the bimetallic plate is deformed to drive the swinging member to cut off the power so as to protect the electric appliance from being damaged and ensure the safety in using electricity.

Accidents due to improper use of electricity have taken place more and more frequently. Therefore, it is necessary to provide an effective protection measure for ensuring safety in using electricity. The most widely used protection measure is the current limiting device mounted on the main circuit, such as a fuse or interrupter which is able to cut off the power in the case of overload. However, it is necessary to replace the fuse each time after fused. This causes great inconvenience. On the other hand, the interrupter has complicated structure and high price so that it is uneconomic to use the interrupter on each line. Also, it is difficult to mount the interrupter. Therefore, generally the interrupter is made with relatively great current specification, so that several lines of smaller current can commonly use one interrupter so as to save cost and facilitate installation. As a result, the precision of the interrupter can hardly meet the requirements for security of various circuits with different current limitations.

SUMMARY OF THE INVENTION

It is a primary object of the present invention to provide a titterboard type switch with security structure, wherein a relay unit is disposed between two terminal legs connected with power wires. The relay unit includes a swinging plate controlled and driven by a push button of the switch. The swinging plate serves to push a movable contact. A bimetallic plate is curved in the case of overload and high temperature to push the swinging plate so as to make the movable contact disconnected from the terminal leg of the power switch. Before the bimetallic plate is restored to its original state, the swinging plate keeps the movable contact in a power cut state without being affected by the depression of the push button. Therefore, great current is avoided to protect the electric appliances and wires from burning down so as to avoid accident and ensure safety in using electricity. The present invention can be best understood through the following description and accompanying drawings, wherein:

DETAILED DESCRIPTION OF THE PREFERRED EMBODIMENT

Figure 1:
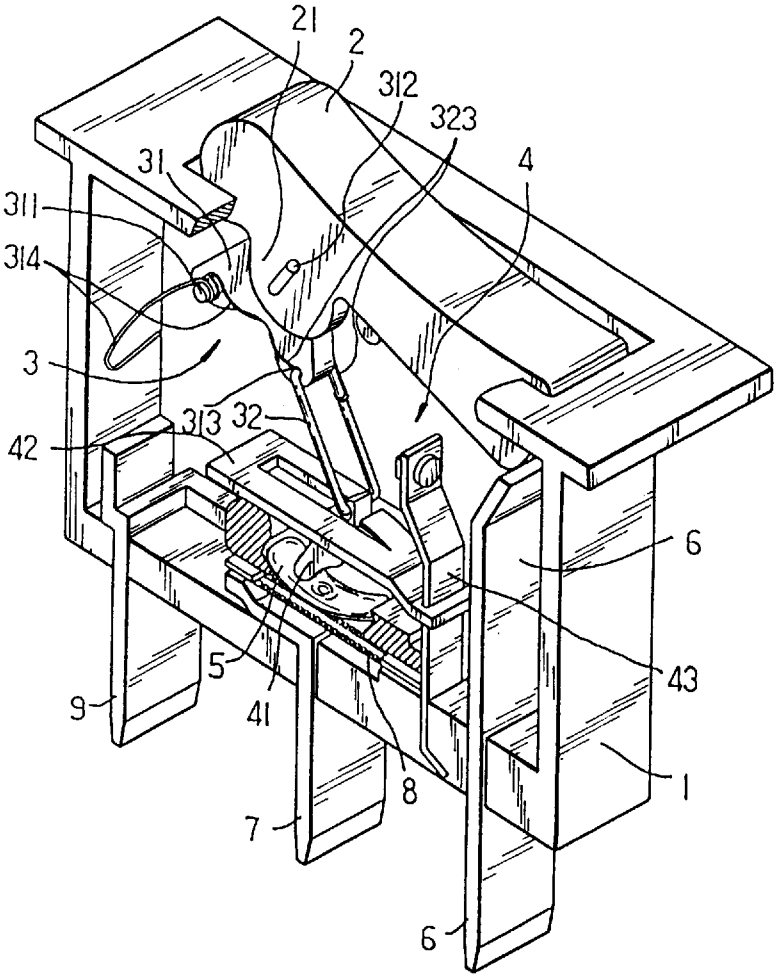
FIG. 1 is a perspective view of the present invention.
Figure 2:
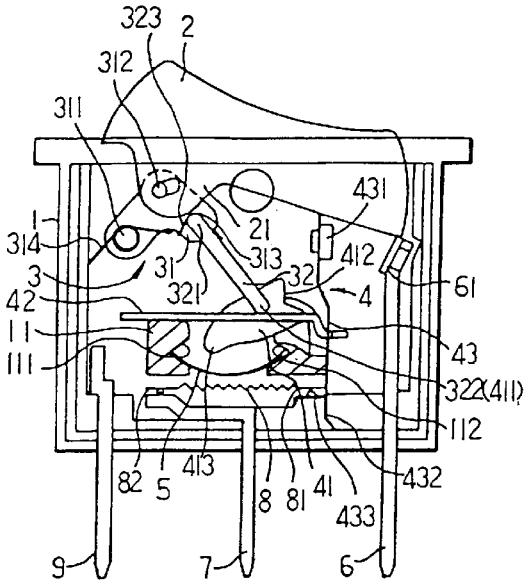
FIG. 2 is a sectional view of the present invention in a power cut state.
Figure 5:
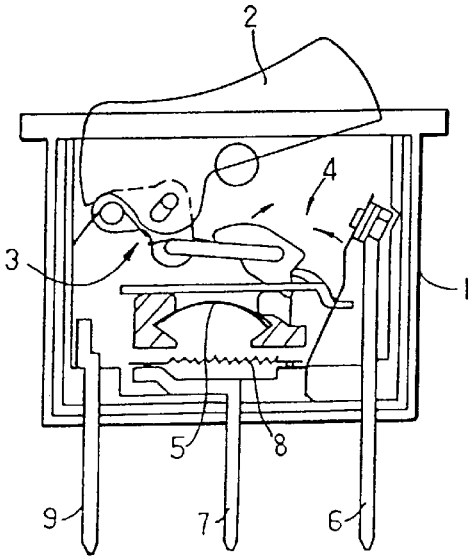
FIG. 5 is a sectional view of the present invention, showing that in the case of overload, the movable contact starts to turn.
Figure 4:
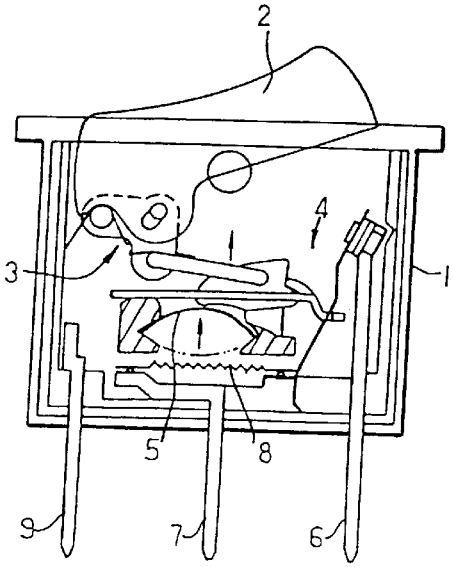
FIG. 4 is a sectional view of the present invention, showing that the bimetallic plate is heated and deformed due to overload so as to push up the swinging plate.
Figure 7:
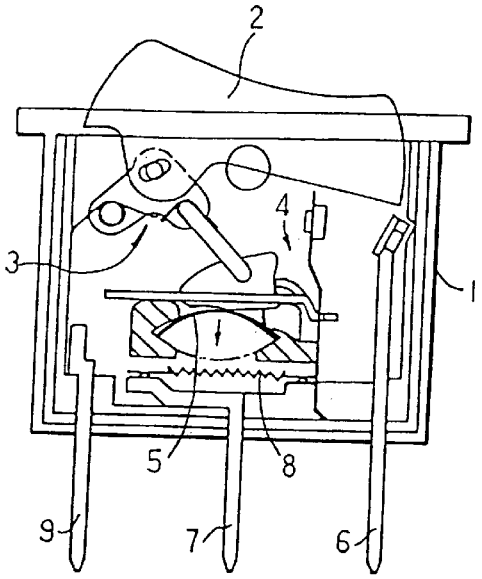
FIG. 7 is a sectional view of the present invention, showing that the swinging plate is restored downward but the bimetallic plate is not yet restored to its original state.

Please refer to FIGS. 1 and 2. The present invention includes a housing 1, a push button 2, a linking unit 3, a relay unit 4, a bimetallic plate 5, two terminal legs 6, 7 and an electrothermal conductor 8.

The push button 2 is disposed on the housing 1. The push button 2 is formed with an extension section 21 pivotally connected with the linking unit 3.

The linking unit 3 includes a linking arm 31 and a linking lever 32. The linking arm 31 has a pivot shaft 311 pivotally connected with the housing 1. A resilient member 314 is connected between the linking arm 31 and the housing 1, whereby the linking arm 31 tends to rotate toward the push button 2. The linking arm 31 is further formed with two pivot points 312, 313 respectively pivotally connected with the extension section 21 of the push button 2 and one end 321 of the linking lever 32. The other end 322 of the linking lever 32 is pivotally connected with a swinging plate 41 of the relay unit 4. A resilient member 323 is disposed between the linking arm 31 and the linking lever 32, whereby the linking lever 32 is subject to a force and tends to swing downward.

The relay unit 4 mainly includes a swinging plate 41, a sliding plate 42 and a resilient movable contact 43. The swinging plate 41 has a pivot point 411 pivotally connected with the end 322 of the linking lever. One end of the swinging plate is formed with a recessed pushing section 412 for pushing the sliding plate 42 toward the movable contact 43. The other end thereof is formed with a pushing end 413 facing a deformation position of the bimetallic plate 5. One end of the movable contact 43 is disposed with a contact point 431, while the other end 432 thereof is fixedly inserted with the housing 1. The section between the two ends is pushed and Pulled by the sliding plate 42. Therefore, when the sliding plate 42 pushes the contact point 431 of the movable contact 43, the contact point 431 is resiliently biased to contact with the contact point 61 of the terminal leg 6. Reversely, when the movable contact 43 is released from the pushing force of the sliding plate 42, the contact point 431 is resiliently restored to a non-contact position and the sliding plate 42 is also resiliently restored back to its home position. The sliding plate 42 is slidably retained on a retaining seat 11 in the housing 1. The movable contact 43 is disposed with an externally connecting section 433 for electrically connecting with one end 81 of the electrothermal conductor 8 and an indicator leg 9.

The bimetallic plate 5 is installed on the retaining seat 11 of the housing 1. The retaining seat 11 is formed with two dents 111, 112 for inserting therein two ends of the bimetallic plate 5. The upper side of the bimetallic plate 5 corresponds to a swinging down position of the swinging plate 41.

One of the terminal legs 6, 7 is an incoming leg 6, while the other thereof is an outgoing leg 7. The incoming and outgoing legs 6, 7 are fixedly secured on the housing 1. The incoming leg 6 is disposed with a contact point 61 for contacting with the contact point 431 of the movable contact 43. One end of the outgoing leg 7 is connected with the other end 82 of the electrothermal conductor 8.

Two ends 81, 82 of the electrothermal conductor 8 are respectively connected with the externally connecting section 433 of the movable contact 43 and the outgoing leg 7 and are positioned adjacent to lower side of the bimetallic plate 5. The electrothermal conductor 8 can be an electrothermal wire or electrothermal panel or PTC Thermistor for over-current protection which can rediate heat and limit current or the like.

Figure 3:
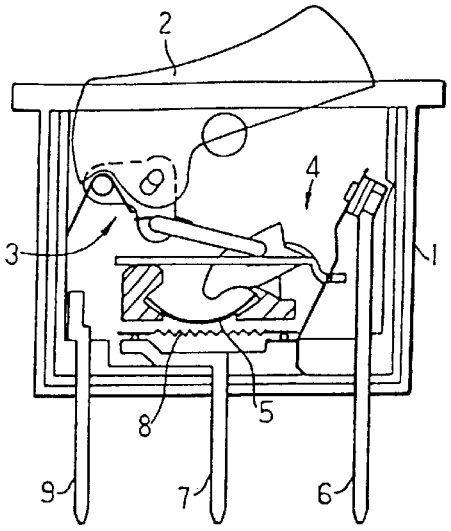
FIG. 3 is a sectional view of the present invention in a powered on state.
Figure 6:
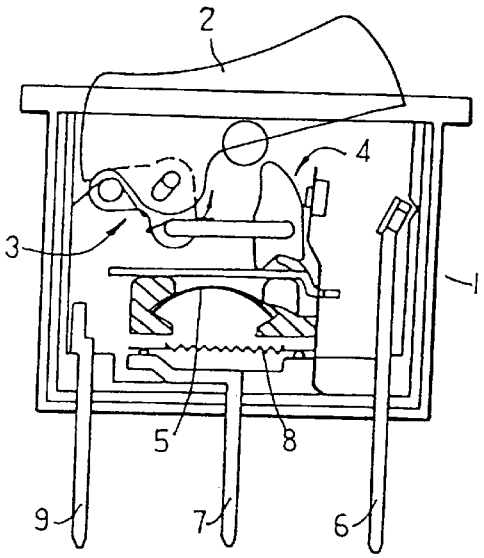
FIG. 6 is a sectional view of the present invention, showing that in the case of overload, the movable contact is totally restored and the swinging plate and the linking unit start to restore to their home positions.
Figure 8:
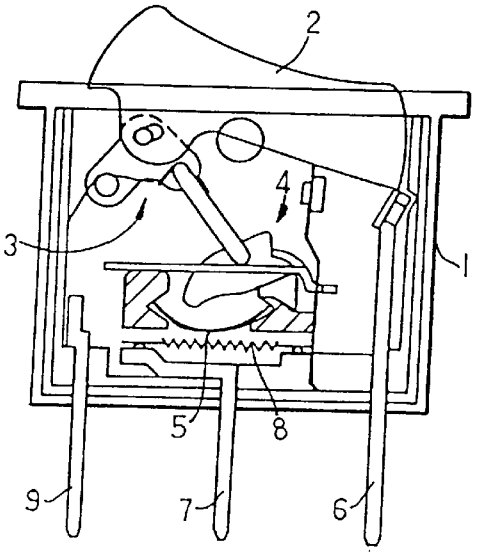
FIG. 8 is a sectional view of the present invention, showing that the switch is totally restored to the power cut state.

FIG. 2 shows a state in which the switch of the present invention is not switched on to electrically connect with the power supply. Under such circumstance, the linking arm 31 is positioned at a swinging up position and the swinging plate 41 of the linking lever 32 is forced by the resilient member 323, whereby the linking lever 32 tenderly presses the sliding plate 42 and the recessed pushing section 412 of the swinging plate 41 tenderly abuts against the sliding plate 42. The sliding plate 42 is moved by the movable contact 43 and positioned at a retrieving position. Also, the movable contact 43 is in a non-contacting power cut state (as shown in FIG. 2). When the push button 2 is depressed in a switching on direction (to left side of the figure), the linking arm 31 is downward swung about the pivot shaft 311. Then the linking lever 32 is urged to press the swinging plate 41, whereby the recessed pushing section 412 thereof pushes the sliding plate 42 and the contact point 431 of the movable contact 43 toward the incoming leg 6 until contacting with the contact point 61 thereof. At this time, the two terminal legs 6, 7 are electrically connected. However, the pushing end 413 of the swinging plate 41 is still positioned above the bimetallic plate 5 in a fastened stationary state rather than in a tenderly pressed state as aforesaid (as shown in FIG. 3). In the case of overload of power supply, the current passing through the electrothermal conductor 8 will abruptly increase to create high temperature. Therefore, the bimetallic plate 5 is heated and tends to instantaneously deform to the other side. The instantaneous deformed bimetallic plate 5 quickly pushes the pushing end 413 of the swinging plate 41, whereby the swinging plate 41 is swung about the pushing section 412 to turn up the pushing end 413. When turned up to such an extent that the pivot point 411 of the linking lever 32 passes over the pushing position of the sliding plate 42, the pushing force of the swinging plate 41 onto the sliding plate 42 disappears. As a result, the sliding plate 42 is subject to the resilient restoring force of the movable contact 43 to quickly move back to its home position. Therefore, the movable contact 43 is quickly separated from the incoming leg 6 to a position as shown in FIG. 6. At this time, the linking unit 3 tenderly presses the swinging plate 41 so that the resilient member 314 disposed at the pivot shaft 311 of the linking arm 31 exerts a resilient restoring force onto the linking arm 31 to move toward the push button 2. Accordingly, the push button 2 is moved to the switching off position. At the same time, the linking unit 3 gradually drives the linking lever 32 and the swinging plate 41 and via the small spring 323 on the linking lever 32 makes the swinging plate 41 turn back to its home position until the swinging plate 41 along with the linking lever 32 tenderly presses the sliding plate 42 and the pushing end 413 leans against upper side of the bimetallic plate 5. It should be noted that at this time, the bimetallic plate 5 is still not cooled so that the swinging plate 41 and the pivot point 411 of the linking lever 32 are not yet lowered to lower side of the fulcrum of pushing section 412 of the swinging plate 41. Therefore, in case at this time the push button 2 is again depressed, the linking unit 3 will only directly push the swinging plate 41 to directly turn upward, while failing to push the sliding plate 42, that is, failing to make the movable contact 43 move to the incoming leg 6 for electric connection. Therefore, the power remains cut off to avoid damage of electric appliance due to mis-touch. After a period of time, the bimetallic plate 5 is cooled and gradually restored to its home state, the swinging plate 41 is also restored to its home state (as shown in FIG. 2 or FIG. 8).

In conclusion, the present invention provides a safety switch structure which is able to avoid abnormal current passing through the circuit so as to ensure safety in using electricity.

It should be noted that the above description and accompanying drawings are only used to illustrate one embodiment of the present invention, not intended to limit the scope thereof. Any modification of the embodiment should fall within the scope of the present invention.

What is claimed is:

1. A safety switch with security structure, comprising a housing, a push button, a linking unit, a relay unit, a bimetallic plate, two terminal legs and an electrothermal conductor, wherein:

the relay unit is disposed between the two terminal legs and the electrothermal conductor is connected between the relay unit and one of the terminal legs, the relay unit being disposed with a resilient movable contact engageable by a sliding plate for controlling whether the movable contact contacts with the other terminal leg or not, the sliding plate being pushed by a swinging plate in a tenderly pressing and lowered state, the linking unit being pivotally connected between the push button and the swinging plate, the swinging plate via the linking unit being pressed and operated by the push button to move, the bimetallic plate being disposed between the electrothermal conductor and the swinging plate, whereby when heated, the bimetallic plate is deformed toward the swinging plate to touch and push the swinging plate, whereby when the push button is depressed and switched on, via the linking unit and relay unit, the movable contact is pushed to electrically contact with the opposite terminal leg to turn on the power, in the case of overload of power, the electrothermal conductor creating high temperature to make the bimetallic plate deform toward the swinging plate so as to push the swinging plate away from the pushing position and release the movable contact from pressing force, whereby the movable contact is resiliently restored to a power cut state to ensure safety from overload.

2. A switch as claimed in claim 1, wherein the push button is disposed with an extension section pivotally connected with the linking unit, the linking unit including a linking arm and a linking lever, the linking arm having a pivot shaft pivotally connected with the housing and pivot points respectively pivotally connected with the extension section and one end of the linking lever, the other end of the linking lever being pivotally connected with the relay unit.

3. A switch as claimed in claim 2, wherein the pivot section of the linking arm is disposed with a resilient member, one end of the resilient member acting on the linking arm, whereby the linking arm tends to be biased toward the push button.

4. A switch as claimed in claim 2, wherein the pivot point of the linking arm connecting with the linking lever is disposed with a resilient member, at least one end of the resilient member acting on the linking lever, whereby the linking lever tends to swing down.

5. A switch structure as claimed in 3, wherein the pivot point of the linking arm connecting with the linking lever is disposed with a resilient member, at least one end of the resilient member acting on the linking lever, whereby the linking lever tends to swing down.

6. A switch as claimed in claim 2, wherein the relay unit includes a swinging plate, a sliding plate and a movable contact, the swinging plate having a pivot point pivotally connected with the end of the linking lever, one end of the swinging plate being formed with a recessed pushing section for pushing the sliding plate toward the movable contact, the other end thereof being formed with a pushing end facing a deformation position of the bimetallic plate, one end of the movable contact being disposed with a contact point, while the other end thereof being fixedly inserted with the housing, the section between the two ends of the movable contact being pushed and pulled by the sliding plate, whereby when the sliding plate pushes the contact point of the movable contact, the contact point is resiliently biased to electrically contact with the contact point of the corresponding terminal leg, when the movable contact is released from the pushing force of the sliding plate, the contact point being resiliently restored to a non-contact position and the sliding plate being resiliently restored back to its home position.

7. A switch as claimed in claim 3, wherein the relay unit includes a swinging plate, a sliding plate and a movable contact, the swinging plate having a pivot point pivotally connected with the end of the linking lever, one end of the swinging plate being formed with a recessed pushing section for pushing the sliding plate toward the movable contact, the other end thereof being formed with a pushing end facing a deformation position of the bimetallic plate, one end of the movable contact being disposed with a contact point, while the other end thereof being fixedly inserted with the housing, the section between the two ends being pushed and pulled by the sliding plate, whereby when the sliding plate pushes the contact point of the movable contact, the contact point is resiliently biased to electrically contact with the contact point of the corresponding terminal leg, when the movable contact is released from the pushing force of the sliding plate, the contact point being resiliently restored to a non-contact position and the sliding plate being resiliently restored back to its home position.

8. A switch as claimed in claim 4, wherein a retaining seat is fixed on the housing between the sliding plate and the electrothermal conductor, the sliding plate being slidably retained on the retaining seat.

9. A switch as claimed in claim 5, wherein a retaining seat is fixed on the housing between the sliding plate and the electrothermal conductor, the sliding plate being slidably retained on the retaining seat.

10. A switch as claimed in claim 6, wherein a retaining seat is fixed on the housing between the sliding plate and the electrothermal conductor, the sliding plate being slidably retained on the retaining seat.

11. A switch as claimed in claim 7, wherein a retaining seat is fixed on the housing between the sliding plate and the electrothermal conductor, the sliding plate being slidably retained on the retaining seat.

12. A switch as claimed in claim 1, wherein the bimetallic plate is clamped in a retaining seat.

* * * * *